US010082754B2

(12) United States Patent
Kasama et al.

(10) Patent No.: US 10,082,754 B2
(45) Date of Patent: Sep. 25, 2018

(54) FIXING DEVICE AND IMAGE FORMING APPARATUS THEREWITH

(71) Applicant: KYOCERA Document Solutions Inc., Osaka (JP)

(72) Inventors: Kenichi Kasama, Osaka (JP); Akihiro Kondo, Osaka (JP); Kuniaki Nakano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/841,737

(22) Filed: Dec. 14, 2017

(65) Prior Publication Data

US 2018/0196382 A1 Jul. 12, 2018

(30) Foreign Application Priority Data

Jan. 6, 2017 (JP) ..... 2017-001322

(51) Int. Cl.

| | |
|---|---|
| ***G03G 15/20*** | (2006.01) |
| ***G03G 15/02*** | (2006.01) |
| ***G03G 21/02*** | (2006.01) |
| ***G03G 15/16*** | (2006.01) |

(52) U.S. Cl.

CPC ..... *G03G 15/2085* (2013.01); *G03G 15/0216* (2013.01); *G03G 15/161* (2013.01); *G03G 15/2053* (2013.01); *G03G 15/2089* (2013.01); *G03G 21/02* (2013.01)

(58) Field of Classification Search

CPC ..... G03G 15/0216; G03G 15/2085; G03G 15/2089; G03G 15/2053; G03G 15/161; G03G 21/02

See application file for complete search history.

(56) References Cited

U.S. PATENT DOCUMENTS 4,935,785 A * 6/1990 Wildi ..... G03G 15/2057 399/171
5,159,394 A * 10/1992 Jinzai ..... G03G 15/2064 399/322
5,353,105 A * 10/1994 Gundlach ..... G03G 15/161 347/103
5,860,051 A * 1/1999 Goto ..... G03G 15/206 399/329

(Continued)

FOREIGN PATENT DOCUMENTS

JP H07-175356 A 7/1995

*Primary Examiner* — David Bolduc
(74) *Attorney, Agent, or Firm* — Studebaker & Brackett PC

(57) ABSTRACT

A fixing device includes a fixing member, a pressing member, a charger, and adjusting part. The fixing member heats toner images on media. The pressing member forms nips with the fixing member and presses the media. The charger uses a corona discharge that occurs in an electric field generated around a discharging electrode so as to charge the fixing member to a same polarity of toner in the toner images. The adjusting part increases a bias applied to the discharging electrode in accordance with increase of a cumulative number calculated by accumulating a number of the media on which the toner images are fixed or increase of a cumulative printing amount calculated by multiplying a printing rate that indicates a ratio of an area of the toner images to an area of the media by the cumulative number.

7 Claims, 8 Drawing Sheets

(56) References Cited

U.S. PATENT DOCUMENTS

| | | | | |
|---|---|---|---|---|
| 6,952,548 | B2 * | 10/2005 | Uchida | G03G 15/02 250/324 |
| 7,352,987 | B2 * | 4/2008 | Iwata | G03G 15/2028 399/329 |
| 8,892,019 | B2 * | 11/2014 | Hirayama | G03G 15/2021 399/122 |
| 9,841,709 | B2 * | 12/2017 | Nakano | G03G 15/0216 |
| 2006/0062611 | A1 * | 3/2006 | Ohishi | G03G 15/2028 399/328 |
| 2007/0140753 | A1 * | 6/2007 | Berkes | G03G 15/2053 399/324 |
| 2008/0253814 | A1 * | 10/2008 | Suzuki | G03G 15/2039 399/320 |
| 2012/0230746 | A1 * | 9/2012 | Namisaki | G03G 15/2028 399/400 |
| 2014/0356018 | A1 * | 12/2014 | Nakamura | G03G 15/2025 399/99 |
| 2016/0004194 | A1 * | 1/2016 | Kondo | G03G 15/2028 399/323 |
| 2017/0299989 | A1 * | 10/2017 | Nakano | G03G 15/2017 |
| 2017/0308010 | A1 * | 10/2017 | Okajima | G03G 15/2053 |

* cited by examiner

FIXING DEVICE AND IMAGE FORMING APPARATUS THEREWITH

INCORPORATION BY REFERENCE

This application is based on and claims the benefit of priority from Japanese Patent application No. 2017-001322 filed on Jan. 6, 2017, the entire contents of which are incorporated herein by reference.

BACKGROUND

The present disclosure relates to a fixing device and an image forming apparatus therewith.

An image forming apparatus of an electrographic manner includes a fixing device which thermally fixes a toner image to a medium passing through a nip having been formed of a fixing member and a pressing member, each of which rotates. A surface of the fixing member is formed of an electrically insulating material, and may be charged at an opposite polarity to a polarity of the toner by way of friction with the medium passing through the nip. Then, there occurs an offset phenomenon that the toner on the medium adheres to the surface of the fixing member and subsequently the toner transfers to the medium passing through the nip later.

A technique for restraining the offset phenomenon is proposed. For example, there is proposed an image forming apparatus including: a transfer charger which charges a sheet at an opposite polarity to that of a toner in order to transfer a toner image on a photosensitive body; a separating charger which charges the sheet after transferred, at a same polarity as that of the toner; and a power source for offset prevention bias (charger for offset prevention) which charges a surface of a fixing roller of a fixing device at the same polarity as that of the toner. Each of the transfer charger, the separating charger, and the charger for offset prevention is a charger utilizing a corona discharge that has occurred in an electric field around an electrode. The charger for offset prevention varies an intensity of an electric field which is applied to the fixing roller, concurrently with a change of a static elimination charge amount exerted by the separating charger.

SUMMARY

In accordance with an aspect of the present disclosure, a fixing device includes a fixing member, a pressing member, a charger, and adjusting part. The fixing member, while rotating, heats toner images on media. The pressing member, while rotating, forms nips with the fixing member and presses the media passing through the nips. The charger uses a corona discharge that occurs in an electric field generated around a discharging electrode facing the fixing member so as to charge the fixing member to a same polarity of toner in the toner images. The adjusting part increases a bias applied to the discharging electrode in accordance with increase of a cumulative number calculated by accumulating a number of the media on which the toner images are fixed or increase of a cumulative printing amount calculated by multiplying a printing rate that indicates a ratio of an area of the toner images to an area of the media by the cumulative number.

In accordance with an aspect of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to accompanying figures, an embodiment of the present disclosure will be described. A near side of figures such as FIG. 1 will be set as a front side. Arrows Fr, Rr, L, R, U, and D shown in the figures indicate a front side, a rear side, a left side, a right side, an upside, and a downside, respectively.

First Embodiment

Entire Configuration of Color Printer

Figure 1:
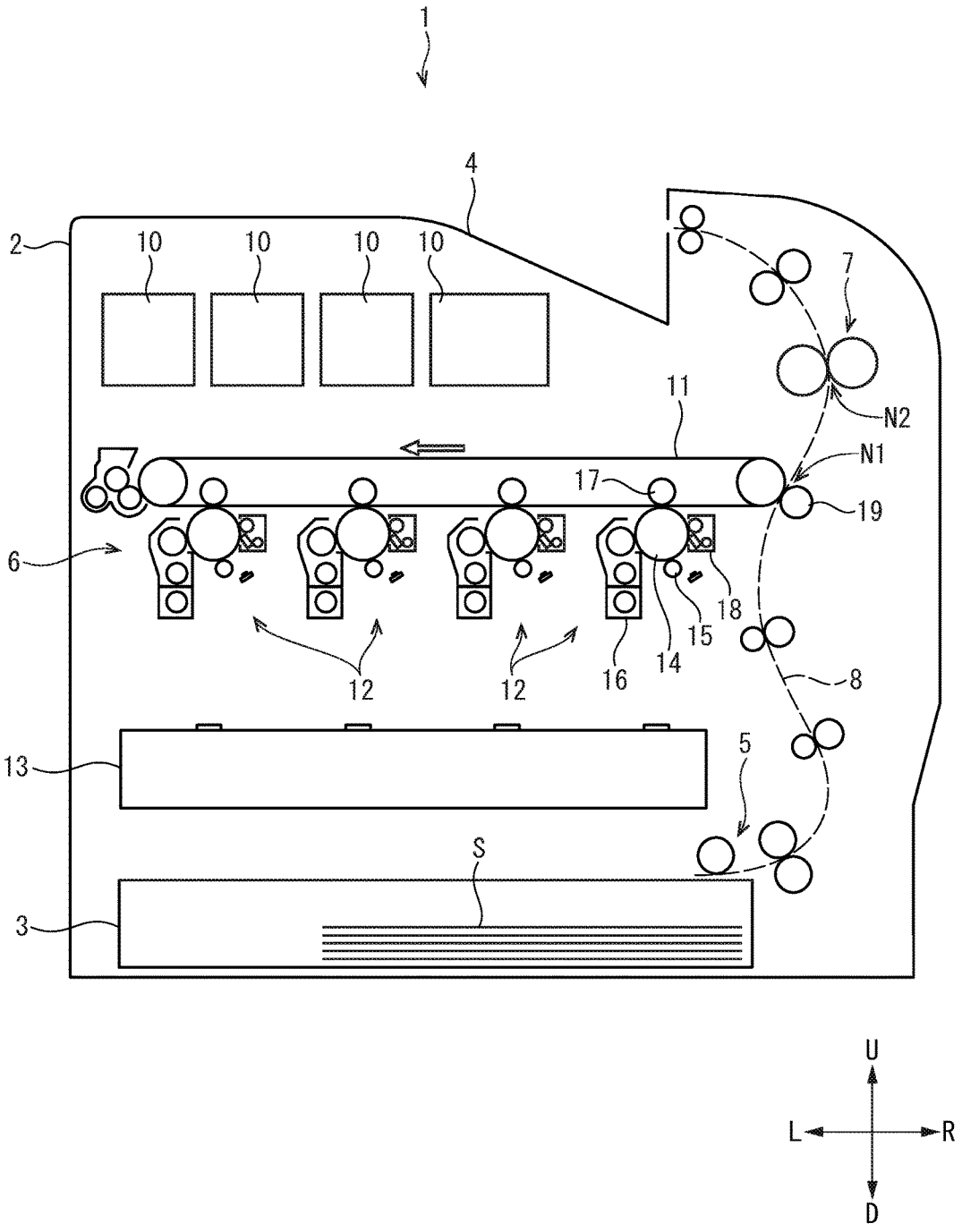
FIG. 1 is a sectional view schematically showing an internal structure of a color printer according to a first embodiment of the present disclosure.

With reference to FIG. 1, an entire configuration of a color printer 1 as an example of an image forming apparatus will be described. FIG. 1 is a sectional view schematically showing an internal structure of the color printer 1.

The color printer 1 includes a main body 2 configurating a substantially rectangular parallelepiped-shaped appearance. In a lower part of the main body 2, a sheet feeding cartridge 3 storing (a stack of) paper sheets S is detachably provided. In an upper surface of the main body 2, an ejected sheet tray 4 is provided. The sheet S, which is an example of a medium, is not limited to the paper sheet and can be a resin sheet or the like.

The color printer 1 includes a sheet feeding device 5, an imaging device 6, and a fixing device 7 in the main body 2. The sheet feeding device 5 is provided at an upstream end of a conveying path 8 extending from the sheet feeding cartridge 3 to the ejected sheet tray 4. The fixing device 7 is provided at a downstream side of the conveying path 8, and the imaging device 6 is provided on the conveying path 8 and between the sheet feeding device 5 and the fixing device 7.

The imaging device 6 includes four toner containers 10, an intermediate transferring belt 11, four drum units 12, and an optical scanning device 13. The four toner containers 10 respectively store four colors (yellow, magenta, cyan, and black) of toners (developers). The intermediate transferring belt 11 rotates in a counterclockwise direction of FIG. 1. Each drum unit 12 includes a photosensitive drum 14, a charger 15, a development device 16, a first transfer roller 17, and a cleaning device 18. Each first transfer roller 17 is provided so as to interpose the intermediate transfer belt 11 between the first transfer roller 17 itself and the corresponding photosensitive drum 14. A second transfer roller 19 is in contact with a right side of the intermediate transfer belt 11 so as to form a transferring nip N1.

The color printer 1 forms an image on a sheet S according to following procedures. Each charger 15 charges a surface of the corresponding photosensitive drum 14. Each photosensitive drum 14 receives a scanning light emitted from the optical scanning device 13 and carries an electrostatic latent image. Each development device 16 develops the corresponding electrostatic latent image to forma toner image using the toner supplied from the corresponding toner container 10. Each first transfer roller 17 primarily transfers the corresponding toner image on the corresponding photosensitive drum 14 to the rotating intermediate transfer belt 11. The intermediate transfer belt 11, while rotating, carries a full-color toner image in which the four-colored toner images are overlapped. The sheet S is fed out by the sheet feeding device 5 from the sheet feeding cartridge 3 to the conveying path 8. The second transfer roller 19 secondarily transfers the toner image having been formed on the intermediate transfer belt 11 to the sheet S passing through the transferring nip N1. The fixing device 7 thermally fixes the toner image on the sheet S. Afterward, the sheet S is ejected to the ejected sheet tray 4. Each cleaning device 18 removes the toner remaining on the corresponding photosensitive drum 14.

Fixing Device

Figure 2:
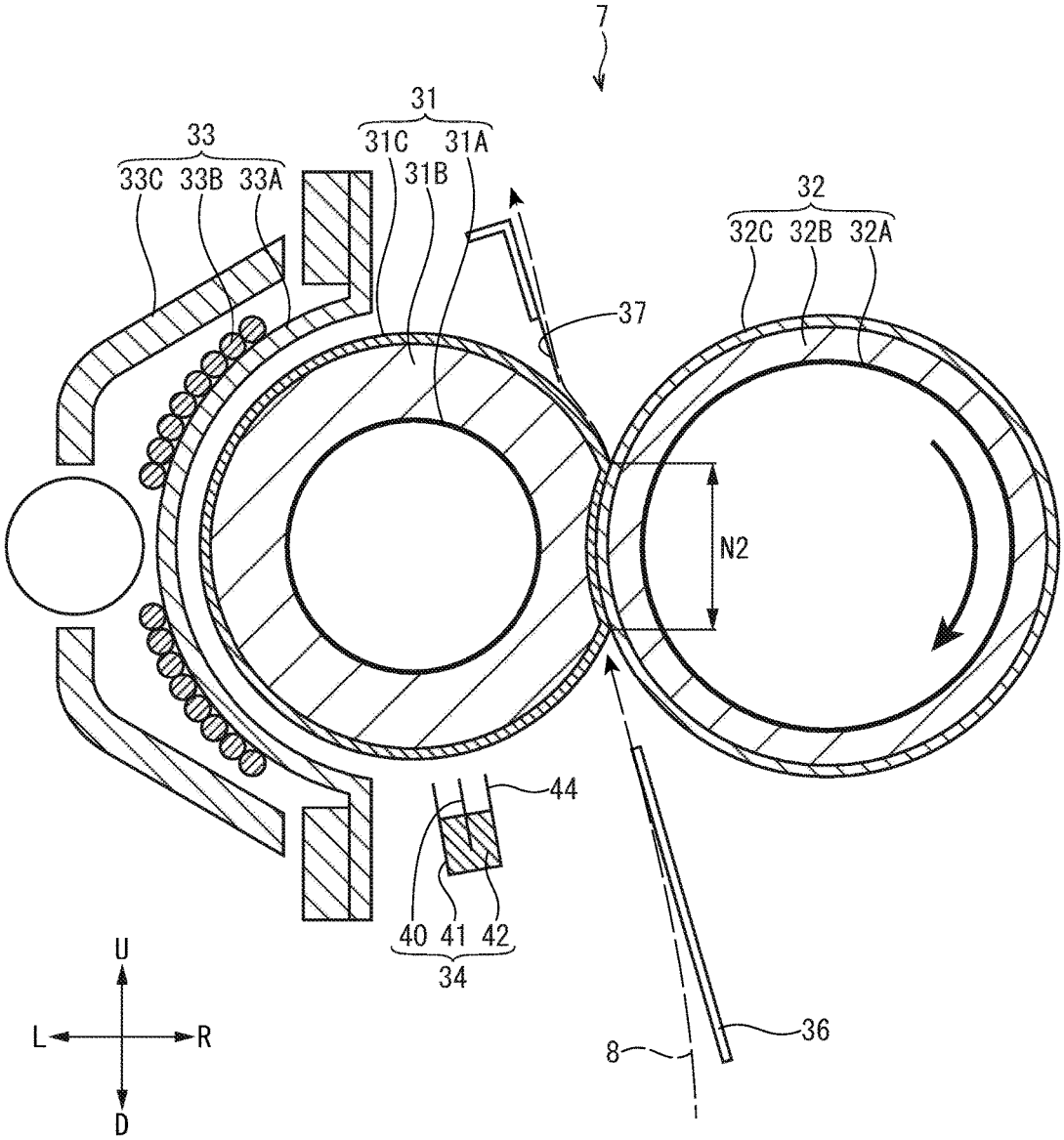
FIG. 2 is a sectional view schematically showing a fixing device according to the first embodiment of the present disclosure.
Figure 3:
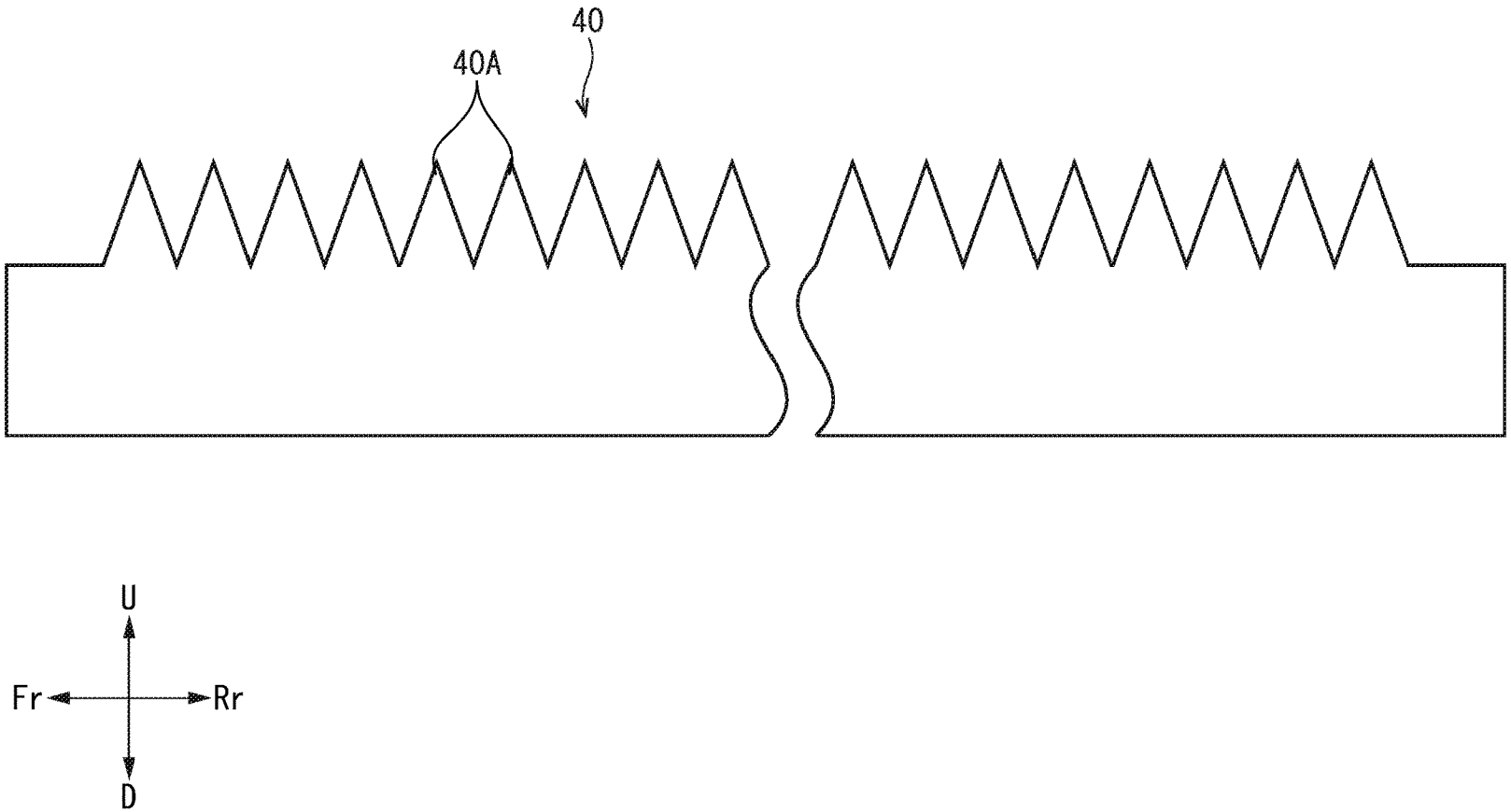
FIG. 3 is a side view schematically showing a discharging electrode of a charger of the fixing device according to the first embodiment of the present disclosure.
Figure 4:
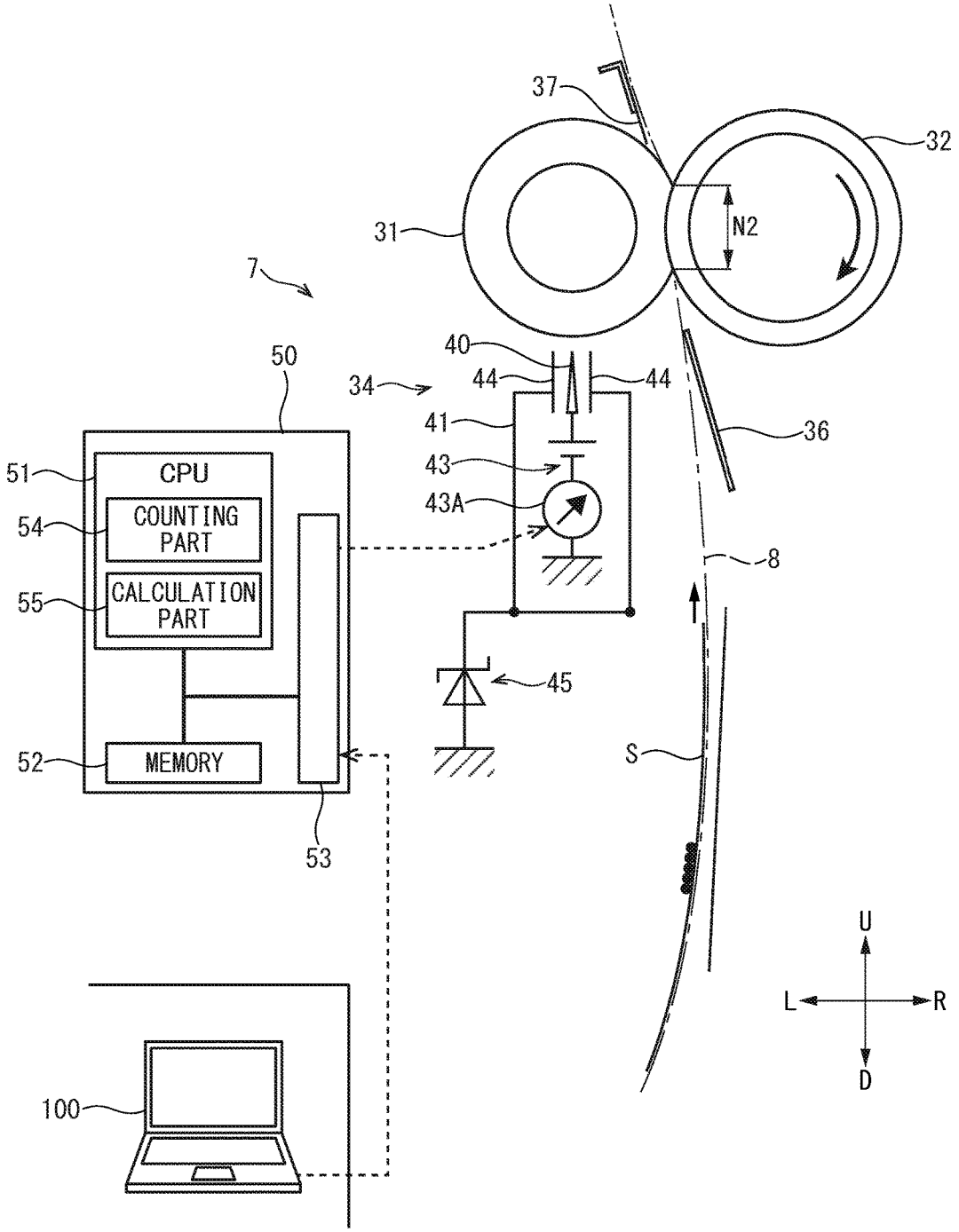
FIG. 4 is a sectional view schematically showing devices such as a fixing device (including an adjusting part) according to the first embodiment of the present disclosure.

With reference to FIG. 2 to FIG. 4, a configuration of the fixing device 7 will be described. FIG. 2 is a sectional view schematically showing the fixing device 7. FIG. 3 is a side view schematically showing a discharging electrode 40 of a charger 34. FIG. 4 is a sectional view schematically showing devices such as the fixing device 7 (including the adjusting part 50).

As shown in FIG. 2, the fixing device 7 includes a fixing roller 31, a pressing roller 32, a heating unit 33, and a charger 34. The fixing roller 31 and the pressing roller 32 are substantially cylindrical members which are elongated in a longitudinal direction (axial direction), respectively. The heating unit 33 is a device configured to heat the fixing roller 31. The charger 34 is a device configured to charge a surface of the fixing roller 31.

The fixing roller 31 as an example of a fixing member includes a fixing cored bar 31A, a fixing elastic layer 31B, and a fixing belt 31C.

The fixing cored bar 31A is made of a metal material, and is formed in a substantially cylindrical shape, for example. Both ends in the longitudinal direction of the fixing cored bar 31A are supported to be rotatable by a pair of metal plates (not shown). The fixing elastic layer 31B is composed of a silicone rubber or the like, for example, and is laminated on an outer circumferential face of the fixing cored bar 31A. The fixing belt 31C is provided so as to cover the fixing elastic layer 31B. The fixing belt 31C includes a release layer (such as a PFA tube) which covers an elastic layer (such as a silicone rubber) provided on a substrate (such as nickel), for example (although not shown).

The pressing roller 32 as an example of a pressing member includes a pressing cored bar 32A, a pressing elastic layer 32B, and a pressing release layer 32C.

The pressing cored bar 32A is made of a metal material, and is formed in a substantially cylindrical shape, for example. Both ends in the longitudinal direction of the pressing cored bar 32A are supported to be rotatable by a pair of movable metal plates (not shown). The pressing elastic layer 32B is composed of a silicone rubber or the like, for example, and is laminated on an outer circumferential face of the pressing cored bar 32A. The pressing release layer 32C is composed of a PFA tube or the like, for example, and is provided so as to cover the fixing elastic later 31B.

The pressing roller 32 is connected to a motor or the like (not shown) via a gear train or the like, and rotates while receiving a driving force of the motor. The pressing roller 32 is biased by a spring (not shown) via each movable metal plate, and is pressed against the fixing roller 31. The fixing roller 31 is sequentially driven by the pressing roller 32, and rotates around a shaft. The pressing roller 32, while rotating, forms a fixing nip N2 together with the fixing roller 31. At an upstream side of a conveying path 8 more significantly than the fixing nip N2, an entry guide 36 for guiding a sheet S to the fixing nip N2 is provided. At a downstream side of the conveying path 8 more significantly than the fixing nip N2, a separating plate 37 for releasing the sheet S passing through the fixing nip N2 from the fixing belt 31C is provided. Although in the embodiment, the pressing roller 32 was driven to rotate, it may be that the fixing roller 31 is driven to rotate, and is followed by the pressing roller 32 being driven to rotate.

The heating unit 33 is provided at an opposite side of the fixing nip N2 while the fixing roller 31 is sandwiched therebetween. The heating unit 33 includes a holder 33A, a plurality of IH coils 33B, and an arch coil 33C. The holder 33A is formed in a substantially semi-cylindrical shape, and is provided so as to cover the fixing roller 31. The plurality of IH coils 33B are supported by the holder 33A. The arch coil 33C is formed of a ferromagnetic body such as a ferrite, and is provided so as to cover the plurality of IH coils 33B.

Here, functions of the fixing device 7 will be described. The fixing roller 31 and the pressing roller 32 rotate around the respective shaft. Each IH coil 33B generates a high frequency magnetic field caused by receiving supply of power from a power source (not shown) so as to heat the fixing belt 31C that rotates. In a case in which an image is formed, the fixing roller 31, while rotating around the shaft, heats a toner image on the sheet S passing through the fixing nip N2. The pressing roller 32, while rotating around the shaft, presses the sheet S passing through the fixing nip N2. Then, the toner image is fixed to the sheet S.

The fixing belt 31C is formed of an electrically insulating PFA tube or the like and thus this fixing belt may be charged at a negative polarity by way of friction with the sheet S passing through the fixing nip N2. Then, there occurs the offset phenomenon that the toner at a positive polarity on the sheet S adheres to the fixing belt 31C and subsequently the toner transfers to the sheet S passing through the fixing nip N2 later. Therefore, the fixing device 7 according to the first embodiment includes the charger 34 that charges the fixing roller 31 (fixing belt 31C) at the same polarity (positive polarity) as that of the toner of the toner image.

Charger

As shown in FIG. 2, the charger 34 is disposed at the upstream side of the conveying path 8 from the fixing nip N2. In other words, the charger 34 is disposed at the downstream side in the rotating direction of the fixing roller 31 while the fixing nip N2 is defined as a start point. The charger 34 includes a discharging electrode 40, a shield 41, an insulating support body 42, and a fixing bias power source 43 (refer to FIG. 4).

As shown in FIG. 3, the discharging electrode 40 is a stainless plate of which thickness is of the order of 0.1 mm, for example, and is formed in a substantially serrated shape while a plurality of needle electrodes 40A are arranged in the longitudinal direction. As shown in FIG. 2, the discharging electrode 40 opposes to the fixing roller 31, and a tip end thereof is proximal to a surface of the fixing roller 31. The shield 41 is made of a metal material, and is formed in a substantially boxy shape which has opened the fixing roller 31 side. An open side of the shield 41 forms a pair of grounding electrodes 44 while the discharging electrode 40 is sandwiched therebetween. The pair of grounding electrodes 44 are grounded via a Zener diode 45 (refer to FIG. 4). The insulating support body 42 is formed of a material having an electrically insulating property. The abovementioned discharging electrode 40 is supported by the shield 41 via the insulating support body 42. The discharging electrode 40 is supported while extending from the insulating support body 42 to the open side of the shield 41.

As shown in FIG. 4, the fixing bias power source 43 is electrically connected to the discharging electrode 40. The fixing bias power source 43 applies a current (fixing bias) to the discharging electrode 40. The fixing bias power source 43 includes a variable circuit 43A which increases or decreases an output of the fixing bias. The charger 34 is a corotron charger which charges the fixing roller 31 (at the positive polarity) by utilizing a corona discharge which occurs in the electric field generated around the discharging electrode 40.

In the meanwhile, it is known that the charger 34 utilizing corona discharge generates a discharging product such as ozone, a nitrogen oxide, a nitrate ion, or an ammonium ion. As the electric field formed around the discharging electrode 40 is stronger, the production amount of the discharging product increases more significantly. In addition, in the toner, a wax is included so that the toner melted by applying a heat and a pressure does not adhere to the fixing roller 31. This wax volatizes from the toner image (toner) at the time of fixing processing, and becomes a floating matter which floats around the fixing roller 31 or the like. The discharging product or floating matter easily adheres to the discharging electrode 40 that is a source of the electric field. The adhesion amount of the floating matter or the like increases while being substantially in proportion to the number of times or time intervals of execution of image forming (fixing) operation.

For example, in a case in which an image forming operation is first carried out, etc., any floating matter or the like does not adhere to the discharging electrode 40 in an initial state. The discharging electrode 40 in the initial state easily exerts an appropriate corona discharge, and is capable of charging the fixing belt 31C substantially uniformly in the axial direction. Therefore, in the discharging electrode 40 in the initial state, charging of the fixing roller 31 in order to restrain the offset phenomenon is achieved by a fixing bias with a low charge. In contrast to this, the discharging electrode 40 to which a floating matter has adhered hardly exerts an appropriate corona discharge, and it may be difficult to charge the fixing belt 31C substantially uniformly in the axial direction. In this case, in order to charge the fixing roller 31 substantially uniformly, it is necessary that a fixing bias which is higher than that in the initial state is applied to the discharging electrode 40. In order to maintain the charging performance of the charger 34 over a long period of time, it is preferable to control the intensity of the electric field by the charger 34, according to the adhesion amount of the floating matter or the like to the discharging electrode 40. Therefore, the fixing device 7 according to the first embodiment includes an adjusting part 50 which varies a fixing bias to be applied to the discharging electrode 40, according to the number of sheets Son which images have been formed (fixed) or the like.

Adjusting Part

Figure 5:
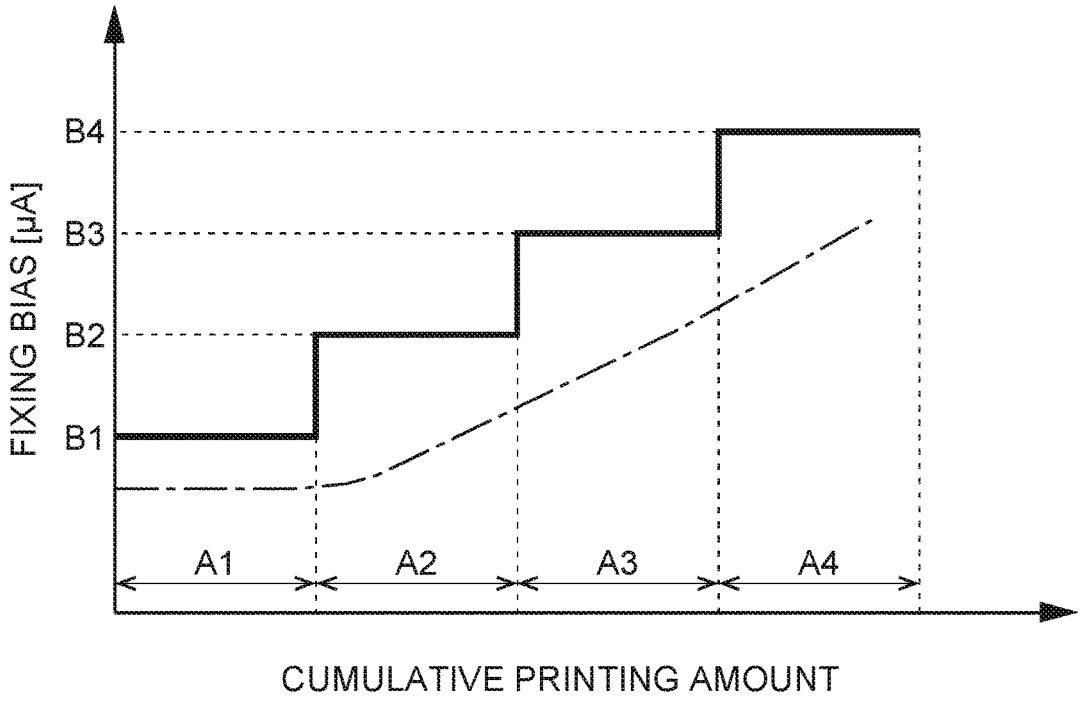
FIG. 5 is a graph showing a relationship between a cumulative printing amount and a fixing bias of the fixing device according to the first embodiment of the present disclosure.

With reference to FIG. 4 and FIG. 5, an adjusting part 50 will be described. FIG. 5 is a graph showing a relationship between a cumulative printing amount and a fixing bias.

The adjusting part 50 is included in a control board (not shown) which controls an image forming operation by the color printer 1. To the control board, an external device 100 such as personal computer is electrically connected (refer to FIG. 4). The control board receives print data or the like which has been transmitted from the external device 100, and appropriately controls each device (such as image forming device 6 or fixing device 7) of the color printer 1 in order to form an image.

As shown in FIG. 4, the adjusting part 50 is a device including a CPU 51, a memory 52, and an input/output port 53 or the like. The CPU 51 executes a variety of arithmetic operations in accordance with programs and data or the like which have been stored in the memory 52. To the input/output port 53, the external device 100 (personal computer) and the fixing bias power source 43 (variable circuit 43A) or the like are electrically connected.

The CPU 51 includes a counting part 54 and a calculation part 55. The counting part 54 counts the number of sheets S onto which toner images are fixed. The calculation part 55 detects a printing rate for each sheet S and then calculates an average value of the printing rates. The printing rate indicates a ratio of an area of the toner image to an area of the sheet S. A value obtained by counting and accumulating the number of sheets S onto which toner images are fixed (an image is formed) is referred to as a cumulative number. The calculation part 55 calculates the cumulative printing amount that has been calculated by multiplying the cumulative number for the printing rate. For example, the cumulative printing amount in a case in which the printing rate is 5% and the cumulative number is 300,000 and the cumulative printing amount in a case in which the printing rate is 30% and the cumulative number is 50,000 are equivalent to each other.

In the memory 52, a table for correlating the cumulative printing amount and the fixing bias to be applied to the discharging electrode 40 with each other is stored. The table is the one that corresponds to the graph shown in FIG. 5 and in a case in which the cumulative printing amount is low, the fixing bias is also set to be low, and in a case in which the cumulative printing amount is high, the fixing bias is also set to be high. In the first embodiment, for example, the cumulative printing amount is divided into four ranges (refer to A1 to A4 in FIG. 5), and the fixing bias of four stages (refer to B1 to B4 in FIG. 5) is set so as to be associated with the cumulative printing amount of the four ranges. That is, the fixing bias is set so as to increase stepwisely (discretely) in response to that the cumulative printing amount continuously increases. The single-dotted chain line shown in FIG. 5 indicates the required minimum fixing bias to restrain the offset phenomenon. Namely, merely by the fixing bias that corresponds to the lower range than the single-dotted chain line, the surface of the fixing roller 31 cannot be sufficiently charged, and the offset phenomenon cannot be restrained. Therefore, the fixing bias of the four stages (B1 to B4) is set so as to correspond to the upper range than the single-dotted chain line.

In FIG. 5, A1 is an initial value (range) of the cumulative printing amount, and B1 is an initial value of the fixing bias. The initial value B1 of the fixing bias is set to a value by which the offset phenomenon can be restrained in a case in which the fixing roller 31 has been charged by employing the discharging electrode 40 in the initial state. The initial value (A1) of the cumulative printing amount is set in a range in which the offset phenomenon can be restrained in a case in which the fixing roller 31 has been charged by the initial value (B1) of the fixing bias. It is preferable to experimentally obtain the cumulative printing amount (A1 to A4) and the fixing bias (B1 to B4) in advance.

Control of Fixing Bias

Figure 6:
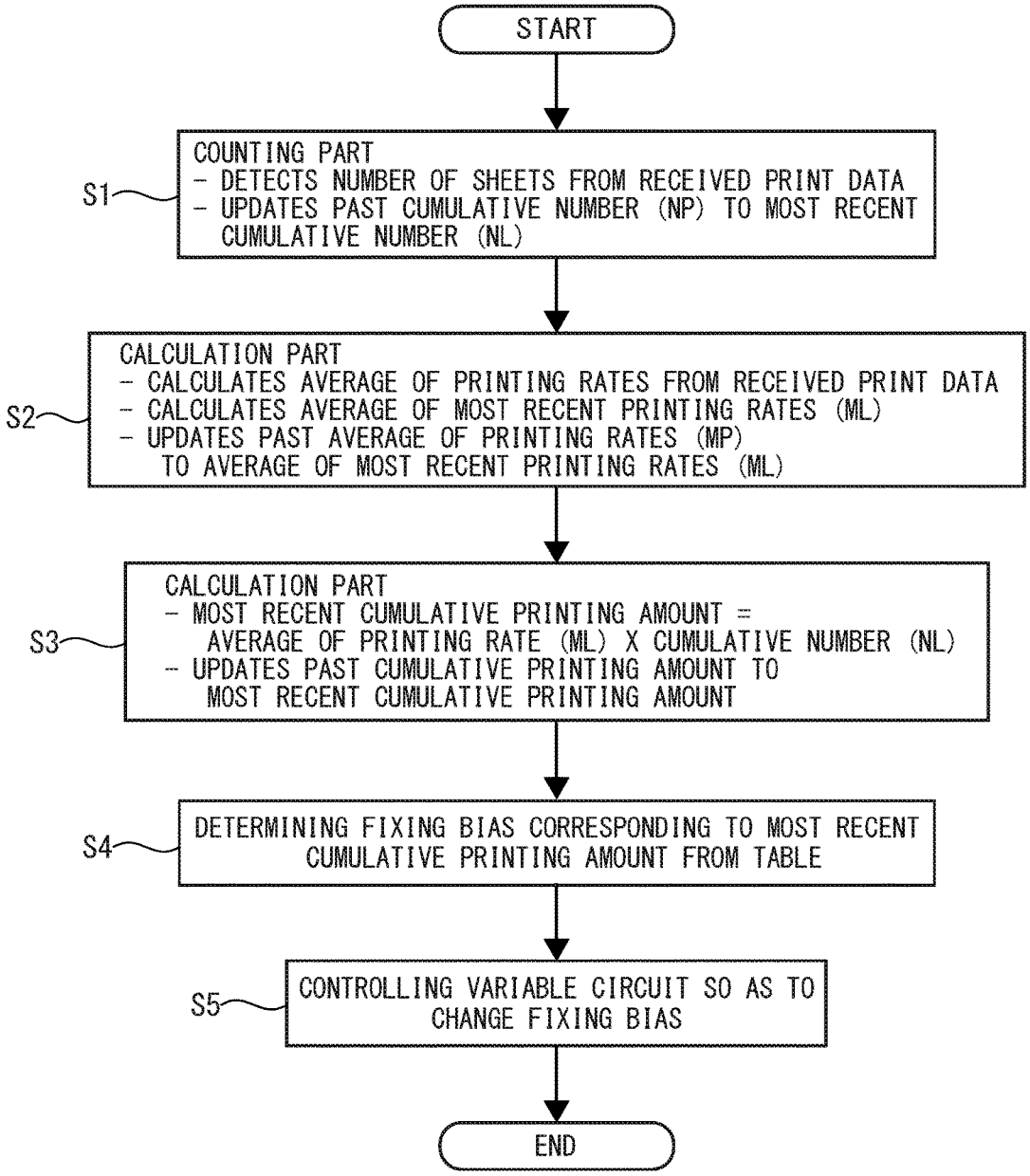
FIG. 6 is a flowchart showing control of the fixing bias of the fixing device according to the first embodiment of the present disclosure.

Next, with reference to FIG. 4 to FIG. 6, control of a fixing bias will be described. FIG. 6 is a flowchart showing control of the fixing bias.

When the control board receives print data from the external device 100, the color printer 1 executes an image forming operation which has been described hereinbefore. The counting part 54 detects, from the received print data, the number of sheets S on which images are to be formed (fixed). In addition, the counting part 54 updates the most recent cumulative number (NL) by adding the detected number of sheets to the cumulative number (NP) at the time of the past image forming operation(s) stored in the memory 52 (step S1).

The calculation part 55 calculates the average value from the printing rates of the respective sheets S, on the basis of the received print data. In addition, the calculation part 55 calculates an average value (ML) of the most recent printing rates from an average value of the thus calculated printing rates and an average value (MP) of the past printing rates that are stored in the memory 52. Then, the calculation part 55 updates the average value (MP) of the past printing rates to the average value (ML) of the most recent printing rates (step S2).

The calculation part 55 calculates the most recent cumulative printing rate by multiplying the cumulative number (NL) for the average value (ML) of the printing rates. The calculation part 55 updates the past cumulative printing rate that is stored in the memory 52, to the most recent cumulative printing amount (step S3).

Next, the CPU 51 determines a fixing bias corresponding to the most recent cumulative printing amount from the table (step S4). Then, the CPU 51 controls the variable circuit 43A so as to output the determined fixing bias (step S5). In the procedure as described above, change (control) of the fixing bias is executed. After the calculation part 55 has updated the average value of the printing rates, the counting part 54 may update the cumulative number. Namely, step S1 may be executed after step S2 or after step S3.

For example, in a case in which the cumulative printing amount (cumulative number and printing rate) is low (refer to A1 in FIG. 5), the discharging electrode 40 is established in an initial state or a state close to the initial state, and it is predicted that the adhesion amount of the floating matter or the like to the discharging electrode 40 is small. The discharging electrode 40 in the initial state achieves substantially uniform charging of the fixing roller 31 at a low fixing bias, in comparison with the discharging electrode 40 to which the floating matter or the like has adhered. Therefore, the adjusting part 50 controls the fixing bias power source 43 so as to apply to the discharging electrode 40 the lowest fixing bias (B1) in FIG. 5.

On the other hand, if an image forming operation is repeatedly carried out, the cumulative printing rate (cumulative number and printing rate) increases (refer to A2 to A4 in FIG. 5). It is predicted that as the cumulative printing amount is higher, the adhesion amount of the floating matter or the like to the discharging electrode 40 increases. In this case, in order to charge the fixing roller 21 substantially uniformly, a fixing bias which is higher than that in the initial state is desired. Therefore, the adjusting part 50 controls the fixing bias power source 43 so as to apply to the discharging electrode 40 a bias which is higher than the fixing bias that is applied to the discharging electrode 40 in the initial state (refer to B2 to B4 in FIG. 5). As described above, the adjusting part 50 increases the fixing bias that is applied to the discharging electrode 40, according to an increase of the cumulative printing amount.

In the fixing device 7 according to the first embodiment described hereinbefore, the adjusting part 50 is configured to increase the fixing bias in a case in which an image forming operation (fixing operation) had been repeatedly executed over a predetermined period of time. That is, the adjusting part 50 predicts the adhesion amount of the floating matter such as a discharging product or a wax component to the discharging electrode 40 and then carries out control to increase the fixing bias. With this configuration, in the initial state, the fixing bias can be set to a low value and thus generation of the discharging product can be restrained. In addition, in the initial state, charging of the fixing roller 31 can be carried out in a condition in which the discharging product or the floating matter hardly adheres to the discharging electrode 40. On the other hand, the fixing bias, in a state in which an image forming operation has been repeatedly executed, is set to be higher than that in the initial state, and even if the floating matter or the like has adhered to the discharging electrode 40, the fixing roller 31 can be thereby charged substantially uniformly. As described above, a period of time during which the discharging electrode 40 is capable of charging the fixing roller 31 substantially uniformly can be extended. Namely, the service life of the charger 34 can be extended.

In addition, in the fixing device 7 according to the first embodiment, the discharging electrode 40 is formed in the substantially serrated shape. With this configuration, a corona discharge can be effectively exerted from the needle electrode 40A towards the fixing roller 31, and the fixing roller 31 can be charged substantially uniformly in the axial direction.

Further, in the fixing device 7 according to the first embodiment, the pair of grounding electrodes 44 oppose to each other while the discharging electrode 40 is sandwiched therebetween, and a stable corona discharge can be thereby exerted from the discharging electrode 40. Furthermore, the pair of grounding electrodes 44 are grounded via the Zener diode 45, and charging of the surface of the fixing roller 31 can be thereby accelerated.

Second Embodiment

Figure 7:
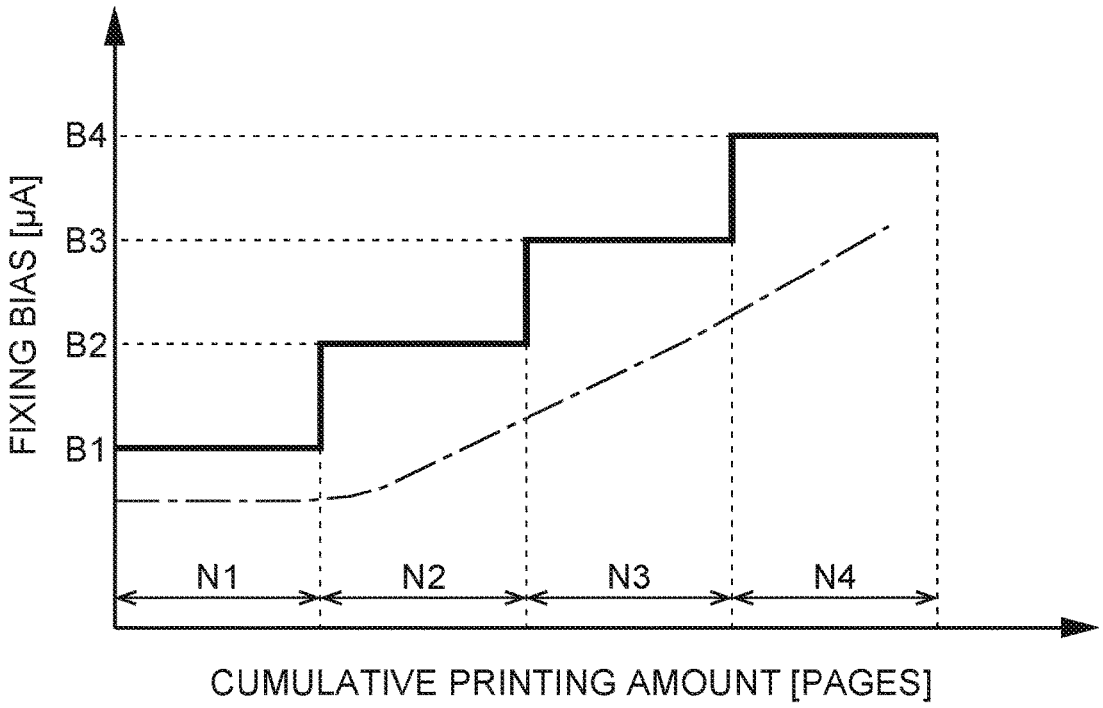
FIG. 7 is a graph showing a cumulative number and a fixing bias of a fixing device according to a second embodiment of the present disclosure.
Figure 8:
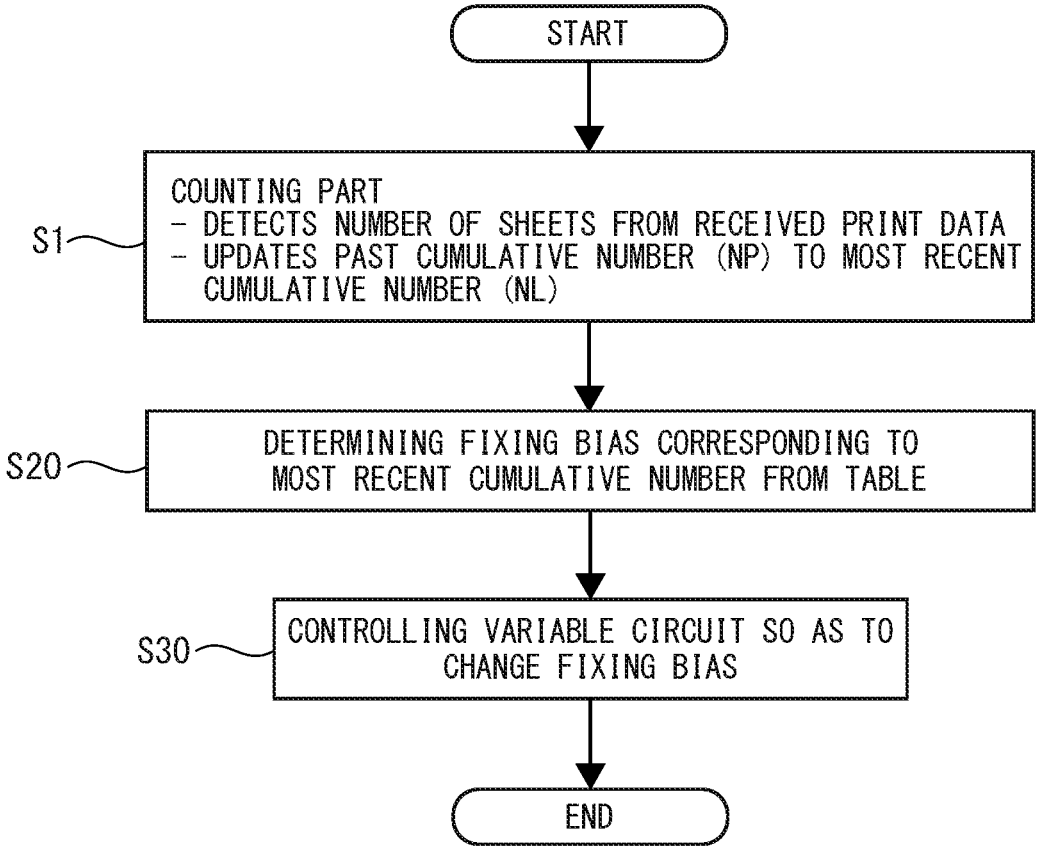
FIG. 8 is a flowchart showing control of the fixing bias of the fixing device according to the second embodiment of the present disclosure.

Next, with reference to FIG. 7 and FIG. 8, a fixing device 7 according to a second embodiment will be described. FIG. 7 is a graph showing a relationship between a cumulative number and a fixing bias. FIG. 8 is a flowchart showing control of the fixing bias. In the following description, like constituent elements in the color printer 1 according to the first embodiment are designated by like reference numerals, and a duplicate description is omitted.

In the fixing device 7 according to the second embodiment, the calculation part 55 (refer to FIG. 4) is omitted from the adjusting part (refer to FIG. 4), or alternatively, even if the calculation part 55 is included, a result of calculation by the calculation part 55 is not used. In addition, in the fixing device 7 according to the second embodiment, a table stored in a memory 52 is different from the one according to the first embodiment.

In the memory 52, the table for correlating a cumulative number and a fixing bias with each other is stored. The table is the one that corresponds to the graph shown in FIG. 7 and in a case in which the cumulative number is low, the fixing bias is also set to low, or alternatively, in a case in which the cumulative number is high, the fixing bias is also set to high. In the second embodiment, for example, the fixing bias of four stages (refer to B1 to B4 in FIG. 7) is set so as to be associated with the cumulative number of four ranges (refer to N1 to N4 in FIG. 7). That is, the fixing bias is set so as to increase stepwisely (discretely) in accordance with a continuous increase of the cumulative number. In FIG. 7, N1 is an initial value (range) of the cumulative number, and is set in a range in which an offset phenomenon can be restrained in a case in which the fixing roller 31 has been charged at the initial value (B1) of the fixing bias. It is preferable to experimentally obtain the cumulative number (N1 to N4) in advance.

As shown in FIG. 8, in control of the fixing bias according to the second embodiment, the same processing operation as that in step S1 of control of the fixing bias according to the first embodiment is executed, and steps S2 and S3 are omitted. Subsequently, a CPU 51 determines, from the table, a fixing bias which corresponds to the most recent cumulative number (NL=any one of N1 to N4) (step S20). Then, the CPU 51 controls a variable circuit 43A so as to output the determined fixing bias (step S30). In the procedure as described above, change (control) of the fixing bias is executed.

For example, in a case in which the cumulative number is low (refer to N1 in FIG. 7), a discharging electrode 40 is set in an initial state, and it is predicted that the adhesion amount of floating matter or the like to the discharging electrode 40 is small. In this case, the adjusting part 50 controls a fixing bias power source 43 so as to apply the lowest fixing bias (B1) in FIG. 7 to the discharging electrode 40. On the other hand, as an image forming operation is repeatedly carried out and then the cumulative number becomes high (refer to N2 to N4 in FIG. 7), it is predicted that the adhesion amount of the floating matter or the like to the discharging electrode 40 increases. In this case, the adjusting part 50 controls the fixing bias power source 43 so as to apply to the discharging electrode 40 a fixing bias (refer to B2 to B4 in FIG. 7) which is higher than the fixing bias that is applied to the discharging electrode 40 in the initial state. As described above, the adjusting part 50 increases the fixing bias that is applied to the discharging electrode 40, according to an increase of the cumulative number.

With the fixing device 7 according to the second embodiment described hereinabove, there can be attained an advantageous effect which is substantially similar to that of the fixing device 7 according to the first embodiment.

Although, in the fixing device 7 according to each of the first and second embodiments, the cumulative printing amount and the cumulative number each are divided into four sections and the fixing bias is varied to four stages, the present disclosure is not limitative thereto. The cumulative printing amount may be divided into two or more sections, and the fixing bias may also be varied to two stages or more. In addition, a table may be set in such as manner as to have a (linear) relationship in which the cumulative printing amount or the like and the fixing bias can be expressed by a linear expression. Namely, the fixing bias may be controlled so as to increase or decrease smoothly (that is, continuously) concurrently with a continuous increase or decrease of the cumulative printing amount or the cumulative number.

Although, in the fixing device 7 according to each of the first and second embodiments, the adjusting part 50 was included in the control board that controls an image forming operation, the present disclosure is not limitative thereto. For example, it may be that the adjusting part 50 is a device independent of the control board and is a dedicated device which controls the fixing device 7 or the fixing bias power source 43.

Also, although, in the fixing device 7 according to each of the first and second embodiments, the fixing belt 31C constitutes the surface of one fixing roller 31, the present disclosure is not imitative thereto. Although not shown, a fixing member may be configured so as to overhang on a plurality of rollers. In addition, although the charger 34 included a substantially serrated electrode, there may be a charger including a discharge wire as an electrode which is overhung on each part in an insulating manner without being limitative thereto. Further, the charger 34 may be a Scorotron charger further including a grid electrode.

Furthermore, although, in the color printer 1 (image forming apparatus) according to each of the first and second embodiments, a toner charged at the positive polarity was employed, a toner charged at the negative polarity may be employed without being limitative thereto. In this manner, it is preferable that the charger 34 charge the surface of the fixing roller 31 at the negative polarity.

In the color printer 1 (image forming apparatus) including the fixing device 7 according to each of the first and second embodiments, the respective advantageous effects described previously are attained.

Still furthermore, although the description of the embodiments was presented as to a case in which the present disclosure was applied to the color printer 1, the present disclosure may be applied to a monochrome printer, a copying machine, a facsimile machine, or a multifunction peripheral or the like, for example, without being limitative thereto.

The description of embodiments merely presents an aspect in a fixing device and an image forming apparatus including the same, according to the present disclosure, and the technical scope of the present disclosure is not limitative to the foregoing embodiment.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member configured to, while rotating, heat toner images on media;

a pressing member configured to, while rotating, form nips with the fixing member and to press the media passing through the nips;

a charger configured to use a corona discharge that occurs in an electric field generated around a discharging electrode facing the fixing member so as to charge the fixing member to a same polarity of toner in the toner images; and an adjusting part configured to increase a bias applied to the discharging electrode in accordance with increase of a cumulative number calculated by accumulating a number of the media on which the toner images are fixed or increase of a cumulative printing amount calculated by multiplying a printing rate that indicates a ratio of an area of the toner images to an area of the media by the cumulative number.

2. The fixing device according to claim 1, wherein the adjusting part includes:

a counting part configured to count the number of the media on which the toner images are fixed; and a calculation part configured to detect printing rates respectively corresponding to the media so as to calculate an average value of the printing rates, and configured to calculate the cumulative printing amount.

3. The fixing device according to claim 1, wherein the adjusting part stepwisely increases the bias as the cumulative number continuously increases or as the cumulative printing amount continuously increases.

4. The fixing device according to claim 1, wherein the adjusting part continuously increases the bias as the cumulative number continuously increases or as the cumulative printing amount continuously increases.

5. The fixing device according to claim 1, wherein the discharging electrode is formed by arranging a plurality of needle electrodes in an axial direction of the fixing member.

6. The fixing device according to claim 1, wherein the charger includes a pair of grounding electrodes facing each other across the discharging electrode and being connected to ground through a Zener diode.

7. An image forming apparatus comprising the fixing device according to claim 1.

* * * * *